US008211839B2

(12) United States Patent
Tepper et al.

(10) Patent No.: US 8,211,839 B2
(45) Date of Patent: Jul. 3, 2012

(54) NON-CORROSIVE EP GREASE COMPOSITION

(75) Inventors: Ronald J. Tepper, Fairfield, CT (US); Gaston A. Aguilar, Milford, CT (US); Robert Heverly, Seabrook, TX (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 184 days.

(21) Appl. No.: 12/788,951

(22) Filed: May 27, 2010

(65) Prior Publication Data

US 2011/0294706 A1 Dec. 1, 2011

(51) Int. Cl.
*C10M 141/08* (2006.01)
*C10M 169/04* (2006.01)
*C07D 285/13* (2006.01)

(52) U.S. Cl. ..... 508/274; 508/272; 508/273; 508/335; 508/364

(58) Field of Classification Search ..... 508/272, 508/273, 274, 335
See application file for complete search history.

(56) References Cited

U.S. PATENT DOCUMENTS

| | | | | |
|---|---|---|---|---|
| 2,492,314 | A | 12/1949 | Olin | |
| 3,139,405 | A | 6/1964 | Farmer | |
| 5,246,604 | A | 9/1993 | Vartanian | |
| 6,365,557 | B1 | 4/2002 | Karol et al. | |
| 2006/0035791 | A1 * | 2/2006 | Donnelly et al. | 508/273 |
| 2006/0183648 | A1 | 8/2006 | Hiza et al. | |
| 2009/0156444 | A1 * | 6/2009 | Aguilar et al. | 508/274 |

OTHER PUBLICATIONS

Vanderbilt Technical Data, Vanlube 972M, R.T. Vanderbilt Company, Inc., Jun. 2009.

* cited by examiner

*Primary Examiner* — Ellen McAvoy
*Assistant Examiner* — Vishal Vasisth
(74) *Attorney, Agent, or Firm* — Norris McLaughlin & Marcus P.A.

(57) ABSTRACT

The invention relates to an extreme pressure additive composition with excellent corrosion resistance properties for use in grease, as well as a lubricating grease composition containing the additive. The additive composition is based on (a) approximately equal amounts by mass of antimony diamyldithiocarbamate and zinc diamyldithiocarbamate, and (b) thiadiazole dimer poly(ether)glycol complex; at (a):(b) mass ratio of about 1.6:1 to about 9.6:1.

8 Claims, No Drawings

NON-CORROSIVE EP GREASE COMPOSITION

FIELD OF INVENTION

The present invention is directed to three-component extreme pressure ("EP") additive grease composition composed of the corrosive EP additives that, when used together, are unexpectedly non-corrosive to copper and steel. More specifically, the invention relates to an additive composition comprising (a) antimony diamyldithiocarbamate, (b) zinc diamyldithiocarbamate and (c) thiadiazole/poly(ether)glycol complex.

BACKGROUND

EP greases are formulated to lubricate under highly loaded conditions and require highly effective EP additives to prevent scoring and welding. Antimony diamyldithiocarbamate and thiadiazole/poly(ether)glycol complexes are compounds that have been found to be effective EP grease additives. Representative patents disclosing the use of antimony diamyldithiocarbamate in grease are U.S. Pat. No. 3,139,405 and U.S. Pat. No. 5,246,604, which are incorporated herein by reference. U.S. Pat. No. 6,365,557 discloses thiadiazole/poly(ether)glycol complexes that are produced by heating 2,5-dimercapto-1,3,4-thiadiazole (DMTD) directly in poly(ether)glycol diluents. Although antimony diamyldithiocarbamate and thiadiazole/poly(ether)glycol complexes are excellent extreme pressure additives, these compounds will corrode and/or tarnish copper.

United States Patent Application 20060183648 discloses the use of 1 to 1 (mass to mass) antimony and zinc diamyldithiocarbamate additive combination for use in soap based greases. The combination provides excellent to exceptional EP performance with reduced levels of environmentally undesirable antimony heavy metal. However, the composition has a tendency to corrode copper and steel at concentrations>2.00 mass percent.

SUMMARY OF INVENTION

The invention relates to a lubricant composition comprising the following components:

(a) Major amount (i.e. >95 mass percent) of base grease, such as lithium, lithium complex, aluminum complex, calcium complex organo-clay and polyurea.

(b) about 0.8-1.2 mass percent antimony diamyldithiocarbamate;

(c) about 0.8-1.2 mass percent zinc diamyldithiocarbamate;

(d) about 0.25-1.0 mass percent thiadiazole dimer poly(ether)glycol complex. at (b):(c) mass ratio of about 1:1.

The invention also discloses an additive composition for use in grease. The additive composition is comprised of the following compounds:

(a) approximately equal amounts by mass of antimony diamyldithiocarbamate and zinc diamyldithiocarbamate; and thiadiazole dimer poly(ether)glycol complex;

at (a):(b) mass ratio of about 1.6:1 to about 9.6:1.

DETAILED DESCRIPTION OF THE INVENTION

Antimony diamyldithiocarbamate is usually prepared by reacting 6 equivalents of diamylamine and 6 equivalents carbon disulfide ($CS_2$) with 1 equivalent of antimony oxide ($Sb_2O_3$):

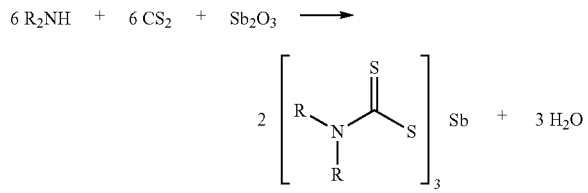

As per U.S. Pat. No. 2,492,314, zinc diamyldithiocarbamate is prepared by one of two general methods. One preparation involves the reaction of 2 equivalents of diamylamine and 2 equivalents of $CS_2$ with 1 equivalent of zinc oxide (ZnO) or zinc hydroxide $Zn(OH)_2$:

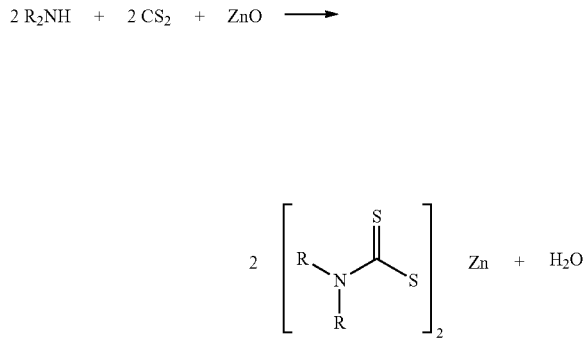

The other preparation involves the reaction of sodium diamyldithiocarbamate with zinc sulfate $Zn(SO_4)_2$ or zinc chloride $ZnCl_2$:

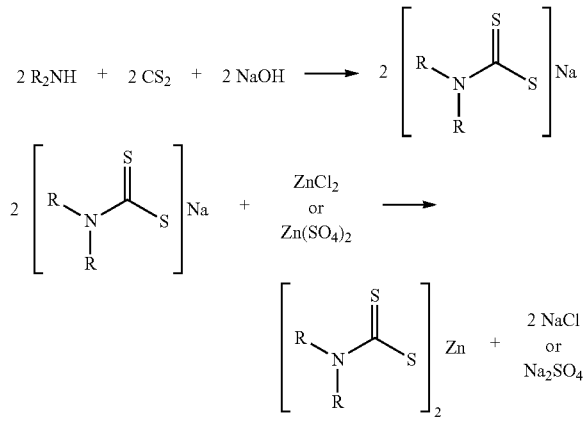

As per United States Patent Application 20060183648, incorporated herein by reference, antimony diamyldithiocarbamate and zinc diamyldithiocarbamate can also be prepared together in a single reaction:

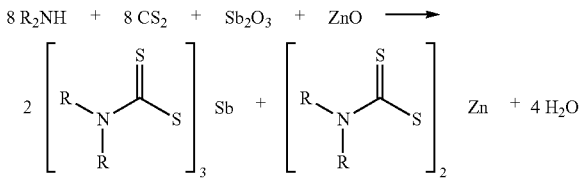

Such a product may be prepared using reactant molar ratio of 3.09:1.00 ($ZnO:Sb_2O_3$) giving a Zinc to Antimony ratio of 1.54:1.00. Specifically, diamyl amine (152.8 grams, 0.971 moles), $Sb_2O_3$ (23.3 grams, 0.080 moles), ZnO (20.1 grams, 0.247 moles), and $CS_2$ (81.2 grams, 1.067 moles) are reacted and diluted with 65.5 grams of diluent oil. The product is filtered to remove traces of un-reacted $Sb_2O_3$ and ZnO. The final product has a bright and clear yellow liquid containing 40 mass percent antimony diamyl dithiocarbamate, 40 mass percent zinc diamyl dithiocarbamate, and 20 mass percent diluent oil. Antimony and zinc contents are 5.96 and 4.92 mass percent respectively.

Thiadiazole/poly(ether)glycol complexes of this invention are described in U.S. Pat. No. 6,365,557, incorporated herein by reference. Preferred embodiments comprise a complex of:

(a) one or more thiadiazole compound as follows:

(i) dimers of 2,5-dimercapto-1,3,4-thiadiazole (DMTD) having the formula:

I

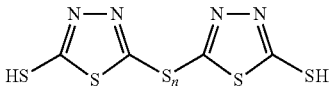

wherein n is 1 and/or 2; and/or (ii) 2-mercapto-1,3,4-thiadiazole (MTD) having formula:

II

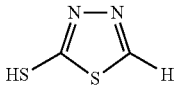

and (b) poly(ether)glycol having formula:

III

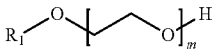

wherein $R_1$ is hydrogen, a branched or straight chain $C_1$ to $C_4$ alkyl radical, a phenyl radical, alkylated phenyl radical, a $C_1$ to $C_8$ branched and straight chain acyl radical, and combination thereof, and m is 1 to 20. Preferred poly(ether) glycols are butoxytriglycol, polyethylene glycol or a combination thereof, with the latter combination being most preferred.

As set out above, the (a) thiadiazole may be one or more of the mono sulfide dimer of DMTD (Formula I, n=1), disulfide dimer of DMTD (Formula I, n=2) and MTD (Formula II); and such is to be complexed with (b) poly(ether)glycol (Formula III).

The complex may comprise, by weight, from about 10% to 60% thiadiazole compound(s) and about 40% to 90% poly(ether)glycol compound(s); preferably about 25% to 50% thiadiazole compound(s) and about 50% to 75% poly(ether) glycol compound(s); and most preferably about 30% to 40% thiadiazole and about 60% to 70% poly(ether)glycol.

A preferred embodiment for the complex is available as Vanlube® 972M additive from R.T. Vanderbilt Company, Inc. of Norwalk, Conn. Vanlube 972M comprises approximately, by weight: (a) 15% mono sulfide dimer of DMTD, 10% disulfide dimer of DMTD, 10% MTD; and (b) 49% butoxytriglycol and 16% polyethylene glycol; and has an average molecular weight of 300 grams per mole.

Another preferred thiadiazole/poly(ether) glycol complex is a thiadiazole dimer complex with Igepal® CA 720, which is iso-octyl phenoxy poly(ether)glycol (CAS#26636-32-8) produced by GAF Corporation, as follows: (a) 15% mono sulfide dimer of DMTD, 10% disulfide dimer of DMTD, 10% MTD; and (b) 65% iso-octyl phenoxy poly(ether)glycol.

Test Methods

Test methods used in this invention to evaluate extreme pressure, corrosion resistance, and wear properties of grease compositions were the following:

1. Timken EP Test
2. Copper Strip Test
3. Rust Test

The Timken test is a well-known standardized test, and described in ASTM D 2509. The Timken test measures the loads at which abrasive wear, i.e. scoring, occur between a rotating cup and stationary block; thus, the higher the Timken OK load, the better the EP properties of the grease.

Copper strip test method, ASTM D 4048, was used to evaluate copper corrosion characteristics of grease compositions. In this test method, the polished copper strip is totally immersed in a sample of grease and heated in an oven at 100° C. for 24 hours. At the end of this period, the strip is removed, washed, and compared with the ASTM Copper Strip Corrosion Standards. A copper strip is assigned a rating of 1a to 4b. A rating of 1a represents a strip with the least amount of corrosion and 4c represents a strip with the maximum amount of corrosion. Commercial greases are non-corrosive and produce ratings no higher than 1b.

Rust Test, ASTM D 1743, was used to evaluate rusting characteristics of grease compositions. In this test method, bearings lubricated with test grease are run under a light thrust load for sixty seconds to distribute the grease in a pattern that might be found in service. The bearings are exposed to water, then stored for 48 hours at 52° C. and 100% relative humidity. Bearing assembly is taken apart, cleaned and bearing cups are examined for evidence of corrosion. Cup is rated a fail if corrosion is evident upon visual inspection. Test is qualified as a pass when at least 2 of 3 cups show no visual evidence of corrosion.

Example 1

EP and copper corrosion properties of lithium complex grease were evaluated. An informal EP ranking based Timken OK load performance for lithium complex grease is provided below; wherein anything in the range 60-80 (excellent or exceptional) is considered acceptable to industry standards:

TABLE 1

| Timken OK Load, (lb.) | EP Performance Ranking |
|---|---|
| 80 | Exceptional |
| 60-70 | Excellent |
| 50 | Good |
| 40 | Marginal |

As per TABLE 2, the lithium complex grease was formulated with Vanlube® 73 (a 50 mass percent antimony dialkyldithiocarbamate additive in mineral oil available from R. T. Vanderbilt Company, Inc. of Norwalk, Conn.), Vanlube® 972M (a thiadiazole poly(ether)glycol complex available from R. T. Vanderbilt Company, Inc. of Norwalk, Conn.), zinc diamyldithiocarbamate, Vanlube 73 in combination with Vanlube 972M, antimony diamyldithiocarbamate in combination with zinc diamyldithiocarbamate at 1:1 and 2:1 mass ratio, respectively, with and without Vanlube 972M. The data shows that only the compositions formulated with 1:1 mass ratio of antimony and zinc diamyldithiocarbamates in the presence of thiadiazole poly(ether)glycol complex carried excellent Timken OK load without tarnishing or corroding copper while eliminating steel corrosion, i.e. rust, completely. Specifically, antimony dialkyldithiocarbamate additives are not effective EP additives at antimony concentration below 0.22 mass percent. Thiadiazole polyether complexes are not effective EP additives at 1 mass percent and lower and will tarnish copper. Zinc dialkyldithiocarbamate are not effective EP additives. Combining antimony dialkyldithiocarbamate additives with thiadiazole will boost EP performance but the composition tarnishes copper. Reducing antimony dialkyldithiocarbamate concentration of this composition eliminates the tarnish problem but EP performance is also lost. Combining antimony dialkyldithiocarbamate with zinc diamyldithiocarbamate, preferably in equivalent mass amount, improves EP performance and allows for lower levels antimony in the grease. However, these grease compositions remain corrosive to copper. Not until antimony and zinc diamyldithiocarbamates at an approximately 1:1 mass ratio are combined with thiadiazole polyether complex, is excellent EP performance, without copper corrosion, achieved at lowest total additive treat rate and antimony metal content in the grease. The effect of dithiocarbamate mass ratio is exemplified by comparing data for formulation 11 that has total additive treat rate of 1.85 mass percent and antimony content of only 0.12 mass percent versus formulation 13 and 14 that have total additive treat rates of 1.85 and 2.1, respectively, and antimony contents of 0.17 mass percent. The latter two formulations were significantly deficient in load-carrying capacity.

Example 2

EP and copper corrosion properties of aluminum complex grease were evaluated. An informal EP ranking based Timken OK load performance for aluminum complex grease is provided below; wherein anything in the range 45-55 (excellent) is considered acceptable to industry standards:

TABLE 3

| Timken OK Load, (lb.) | EP Performance Ranking |
|---|---|
| 45-55 | Excellent |
| 40 | Good |
| 30 | Fair |

As per TABLE 3, the aluminum complex grease was formulated with combinations of various additives: Vanlube® 73 (a 50 mass percent antimony dialkyldithiocarbamate additive in mineral oil available from R. T. Vanderbilt Company, Inc. of Norwalk, Conn.), Vanlube® 8912E (calcium sulfonate rust inhibitor available from R. T. Vanderbilt Company, Inc. of Norwalk, Conn.), antimony diamyldithiocarbamate, zinc diamyldithiocarbamate, and Vanlube 972M or thiadiazole dimer complex with Igepal® CA 720, which is iso-octyl phenoxy poly(ether)glycol (CAS#26636-32-8) produced GAF Corporation. The data shows that only the compositions formulated with antimony diamyldithiocarbamate and zinc diamyldithiocarbamate in combination with thiadiazole poly (ether)glycol complex carried excellent Timken OK load without corroding copper or steel. Specifically, the data shows that aluminum complex grease requires high concentration of antimony dialkyldithiocarbamate additives to provide excellent Timken performance. However, these formulations are highly corrosive to copper. Combining antimony dialkyldithiocarbamate with zinc diamyldithiocarbamate, preferably in equivalent mass amount, improves EP performance and allows for lower levels antimony in the grease. However, these grease compositions remain corrosive to copper and are also corrosive to steel even in the presence of rust inhibitor, Vanlube 8912E. Not until a thiadiazole poly(ether) glycol complex is used in combination with antimony diamyldithiocarbamate and zinc diamyldithiocarbamate is excellent EP performance without copper and steel corrosion achieved.

TABLE 2

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Vanlube 73 | 3.0 | — | — | — | 3.0 | 2.75 | — | — | — | — | — | — | — | — |
| Vanlube 972M | — | 2.0 | 1.0 | — | 0.25 | 0.25 | — | — | 0.25 | 0.25 | 0.25 | — | 0.25 | 0.50 |
| Zinc Diamyldithiocarbamate | — | — | — | 2.0 | — | — | 1.2 | 1.1 | 1.2 | 0.9 | 0.8 | 0.5 | 0.5 | 0.5 |
| Antimony Diamyldithiocarbamate | — | — | — | — | — | — | 1.2 | 1.1 | 1.2 | 0.9 | 0.8 | 1.1 | 1.1 | 1.1 |
| Antimony Content in Grease, mass percent | 0.22 | 0 | 0 | 0 | 0.22 | 0.20 | 0.18 | 0.17 | 0.18 | 0.14 | 0.12 | 0.17 | 0.17 | 0.17 |
| Timken OK Load, lb. | <40 | 80 | <40 | <40 | 80 | <40 | 70 | <40 | 70 | 70 | 60 | <40 | <50 | <60 |
| Copper corrosion | 4b | 2e | 2e | 1a | 2e | 1b | 4b | 4b | 1a | 1a | 1a | 4b | 1a | |
| Rust test | | | | | | | Pass | | Pass | | | | | |
| Individual Cup Ratings | | | | | | | P, P, F | | P, P, P | | | | | |

TABLE 4

| | 15 | 16 | 17 | 18 | 19 | 20 | 21 |
|---|---|---|---|---|---|---|---|
| Vanlube 73 | 5.0 | — | — | — | — | — | |
| Vanlube 8912E | 1.0 | 1.0 | 1.0 | 1.0 | — | — | |
| Zinc Diamyldithiocarbamate | — | 1.0 | 1.1 | 1.3 | 1.0 | 0.8 | 0.8 |
| Antimony Diamyldithiocarbamate | — | 1.0 | 1.1 | 1.3 | 1.0 | 0.8 | 0.8 |
| Vanlube 972M | — | — | — | — | 0.50 | 1.0 | — |
| Thiadiazole dimer complex with Igepal ® CA 720 | — | — | — | — | — | — | 1.0 |
| Antimony Content in Grease, mass percent | 0.37 | 0.15 | 0.17 | 0.20 | 0.15 | 0.12 | 0.12 |
| Timken OK Load, lb. | 45 | <35 | <35 | 50 | 45 | 60 | 60 |
| Copper corrosion | 4b | | | 4b | 1b | 1b | 1b |
| Rust test | Pass | | | Fail | Pass | Pass | |
| Individual Cup Ratings | P, P, F | | | F, F, P | P, P, P | P, P, P | |

What is claimed is:

1. A lubricating composition for providing extreme pressure protection and corrosion resistance, comprising a major amount of base grease, and (a) approximately equal amounts by mass of antimony diamyldithiocarbamate and zinc diamyldithiocarbamate, at a total of about 1.6-2.4 mass %, and (b) thiadiazole dimer poly(ether)glycol complex at about 0.25-1.0 mass %.

2. The composition of claim 1, wherein the thiadiazole dimer poly(ether)glycol complex comprises:

(i) one or more thiadiazole compound as follows:

(A) dimers of 2,5-dimercapto-1,3,4-thiadiazole (DMTD) having the formula:

I

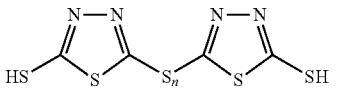

wherein n is 1 and/or 2; and/or (B) 2-mercapto-1,3,4-thiadiazole (MTD) having formula:

II

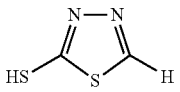

and (ii) poly(ether)glycol having formula:

III

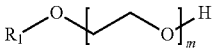

wherein $R_1$ is hydrogen, a branched or straight chain $C_1$ to $C_4$ alkyl radical, a phenyl radical, alkylated phenyl radical, a $C_1$ to $C_8$ branched and straight chain acyl radical, and combination thereof, and m is 1 to 20.

3. The composition of claim 2, wherein the poly(ether) glycols is chosen from one or more in combination of butoxytriglycol, polyethylene glycol and iso-octyl phenoxy poly (ether)glycoll.

4. The composition of claim 3, wherein the poly(ether) glycol is a combination of butoxytriglycol and polyethylene glycol.

5. The composition of claim 2, wherein the thiadiazole dimer poly(ether)glycol complex comprises, in mass percent, about 10% to 60% thiadiazole compound(s) and about 40% to 90% poly(ether)glycol compound(s).

6. The composition of claim 5, wherein the thiadiazole dimer poly(ether)glycol complex comprises, in mass percent, about 25% to 50% thiadiazole compound(s) and about 50% to 75% poly(ether)glycol compound(s).

7. The composition of claim 6, wherein the thiadiazole dimer poly(ether)glycol complex comprises, in mass percent, about 30% to 40% thiadiazole compound(s) and about 60% to 70% poly(ether)glycol.

8. The composition of claim 7, wherein the thiadiazole dimer poly(ether)glycol complex comprises, in mass percent, about:

(i) (A) 15% mono sulfide dimer of DMTD, and 10% disulfide dimer of DMTD,
(B) 10% MTD; and (ii) 65% poly(ether)glycol, being either (I) a combination of 49% butoxytriglycol and 16% polyethylene glycol, or (II) iso-octyl phenoxy poly(ether)glycol.

* * * * *